United States Patent [19]

Erler

[11] 4,069,680

[45] Jan. 24, 1978

[54] METHOD OF AND APPARATUS FOR THE ANCHORING OF DRILLING AND PRODUCTION PLATFORMS ON A STRUCTURE SUNK ON A SEA BOTTOM

[75] Inventor: Eckart Erler, Essen-Bredeney, Germany

[73] Assignee: HOCHTIEF AG fur Hoch-und Tiefbauten vorm. Gebr. Helfmann, Essen, Germany

[21] Appl. No.: 775,401

[22] Filed: Mar. 7, 1977

[30] Foreign Application Priority Data

Mar. 10, 1976 Germany ..... 2609823

[51] Int. Cl.[2] ..... E02D 21/00

[52] U.S. Cl. ..... 61/86; 61/50; 61/53

[58] Field of Search ..... 61/45 C, 50, 53, 86, 61/87, 89, 98

[56] References Cited

U.S. PATENT DOCUMENTS

| | | | |
|---|---|---|---|
| 3,555,833 | 1/1971 | Correa | 61/53 |
| 3,704,595 | 12/1972 | Launay | 61/50 |

FOREIGN PATENT DOCUMENTS

| | | | |
|---|---|---|---|
| 368,877 | 3/1932 | United Kingdom | 61/45 C |

*Primary Examiner*—Paul R. Gilliam
*Assistant Examiner*—David H. Corbin
*Attorney, Agent, or Firm*—Karl F. Ross

[57] ABSTRACT

A system for anchoring drilling or production platforms upon a plurality of posts anchored in the sea bottom or on an artificial island comprises a cylinder structure formed at the top of each of the posts and a plunger depending from a semi-submersible platform adapted to be received with clearance within each of the cylinders. The platform is provided with sand bunkers adjacent the respective plungers and with releasable closures which open upon positioning of the platform above the posts to cause granular material to flow into the cylinder around the respective plungers, thereby cushioning the engagement of the platform by the posts.

10 Claims, 4 Drawing Figures

METHOD OF AND APPARATUS FOR THE ANCHORING OF DRILLING AND PRODUCTION PLATFORMS ON A STRUCTURE SUNK ON A SEA BOTTOM

FIELD OF THE INVENTION

The present invention relates to the anchoring of a drilling or production platform (hereinafter referred to in short as a "platform") upon the columns of a support structure previously affixed in the sea bottom or an artificial island, and, more particularly, to an arrangement for fixing the platform to such a structure whereby the kinetic energy of the platform, resulting from sea movements, is cushioned during the anchoring operation.

BACKGROUND OF THE INVENTION

Drilling and production platforms, e.g. for the recovery of fossil-fuel material, for example, petroleum and natural gas, are frequently anchored to a support structure previously affixed in the sea bottom. Such platforms may be formed as semi-submersible sea-going vessels which can carry the drilling rig or production equipment and are adapted to be partially submerged in the sea and securely affixed to the substructure or support.

The support generally comprises a plurality (usually three) columns or posts which have previously been anchored in the sea bed and which are adapted to be affixed to the platform at their upper end.

Problems have been encountered heretofore in attaching the floating platform to such support posts. The platforms are relatively massive and the movements imparted thereto by the sea generate significant kinetic energy which, during the attachment phase, is frequently transmitted to the posts causing residual deformation or damage to the post or attachment structure.

When the platform is a semi-submersible sea-going vessel, the rise and fall of the level of the sea, the pitch, roll and yaw movements of the platform all impede effective attachment to the supports.

The problem is made more difficult in that the devices which are provided in conventional systems to absorb the high kinetic energy of the platform frequently must also be capable of taking up the full static load. The stresses applied during attachment and thereafter alternately increase and decrease with the sea movements and transmission to the support of these stresses must be prevented by rapid accommodation of the cushioning devices to them.

In spite of the interposition of deformable elements in the form of elastically extendable members or plastically or elastically compressible support cups, the difficulties mentioned above have prevailed to this date and it has been possible to secure a drilling or production platform to the columns in a manner sufficient to withstand environmental extremes only with the greatest difficulty and at relatively high cost.

The attachment devices and cushioning arrangements used heretofore have required constant maintenance and high capital expenditure. In spite of all precautions, moreover, weather extremes have caused failure with serious consequences to the platform and operating personnel, with conventional arrangements.

OBJECTS OF THE INVENTION

It is the principal object of the present invention to provide an improved system for attaching a drilling or production platform of the semi-submersible type to a support structure.

Another object of this invention is to provide an improved method of attaching such a platform to a plurality of columns or posts.

It is also an object of this invention to provide a system of the type described which obviates the disadvantages of earlier systems.

Still another object of the invention is to provide a low cost secure technique for attaching a drilling or production platform to a plurality of posts whereby the sea movements imparted to the platform have little effect on the attachment process and the attachment is such that the platform is able to withstand extremes of weather and other environmental conditions with ease.

Still another object of the invention is to provide an arrangement for securing a drilling or production platform to a plurality of posts which solves both the kinetic-energy and static-support problems discussed above.

SUMMARY OF THE INVENTION

These objects, and others which will become apparent hereinafter are attained, in accordance with the present invention, by providing the platform with a plurality of spaced-apart downwardly extending plungers whose heads or upper portions are surrounded by sand bunkers and whose lower portions are adapted to be received with clearance in socket formed at the tops of respective posts of the support structures. These sockets form sand-receiving cups or pots in which the plungers can be received with clearance and which form cylinders adapted to telescopingly receive the plungers.

According to the invention, the sand bunkers of the semi-submersible platform, which can be constituted as a sea-going vessel adapted to be partially flooded to the lowered onto the support, are provided with remote-control closures adapted to be opened to release a granular material, e.g. a sand simultaneously with the introduction of the plungers into the sockets, into the space between each plunger and the inner wall of the respective cylinder, cup or socket.

In accordance with the invention, the platform is lowered so that the plungers enter into the sockets from above with all-around clearance and, during a rise of the sea and hence a rise of the platform, the sand is released from the bunkers to pass along the sides of the plungers into the socket. Sand release can coincide, in accordance with a feature of the invention with the commencement of the rising stroke of the plunger with respect to the socket, i.e. an elongation of the telescoping structure formed by each cylinder and the associated plunger.

As a result, after termination of this elongation of the telescoping arrangement and rise of the plunger in the cylinder, the space between the cylinder and the plunger is filled with sand which blocks the downward movement of the plunger in the cylinder and laterally anchors and cushions the plunger against the walls of the cylinder. When the sea level then lowers, the platform is supported upon the posts without subjecting the latter to dynamic stress. Any downward forces are cushioned by the bed of sand disposed beneath and around the plungers.

The diameter difference between the socket and the associated plunger should be such that it permits movement of the platform as a result of the movements of the sea in the horizontal direction.

The closures which are openable in accordance with the present invention can be flaps or slides.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 3:
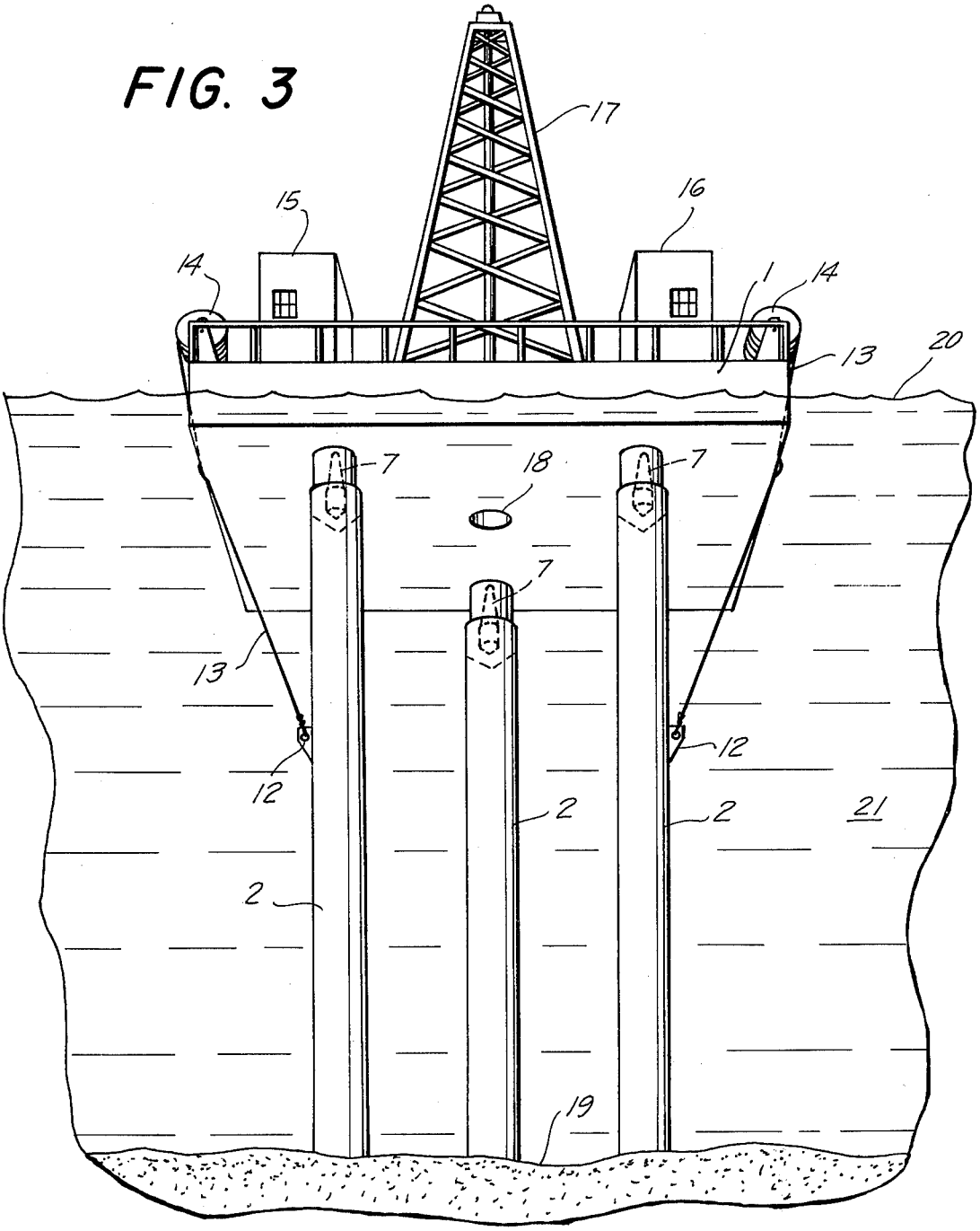
FIG. 3 is a perspective view, partially from below and diagrammatically illustrating an off-shore platform anchored in accordance with the present invention.

Referring first to FIG. 3, it can be seen that a platform 1 of the semi-submersible type can be anchored to a plurality of posts or columns 2 in the sea 21, the posts having previously been anchored on the sea bottom 19 or an off-shore island formed on the sea bottom. The platform 1 can carry a drilling derekly and various housing structures 15 and 16 for pumps or the like for drilling or production of a fossil-fuel substance such as crude oil or natural gas. Winches 14 can be carried by the platform 1 and can have hawsers 13 which can be attached to eyes 12 on the columns 2 to align the plungers 7 with the sockets formed in the upper ends of the columns 2. The platform may have a hole 18 through which the drilling string can pass between the columns 2.

Figure 1:
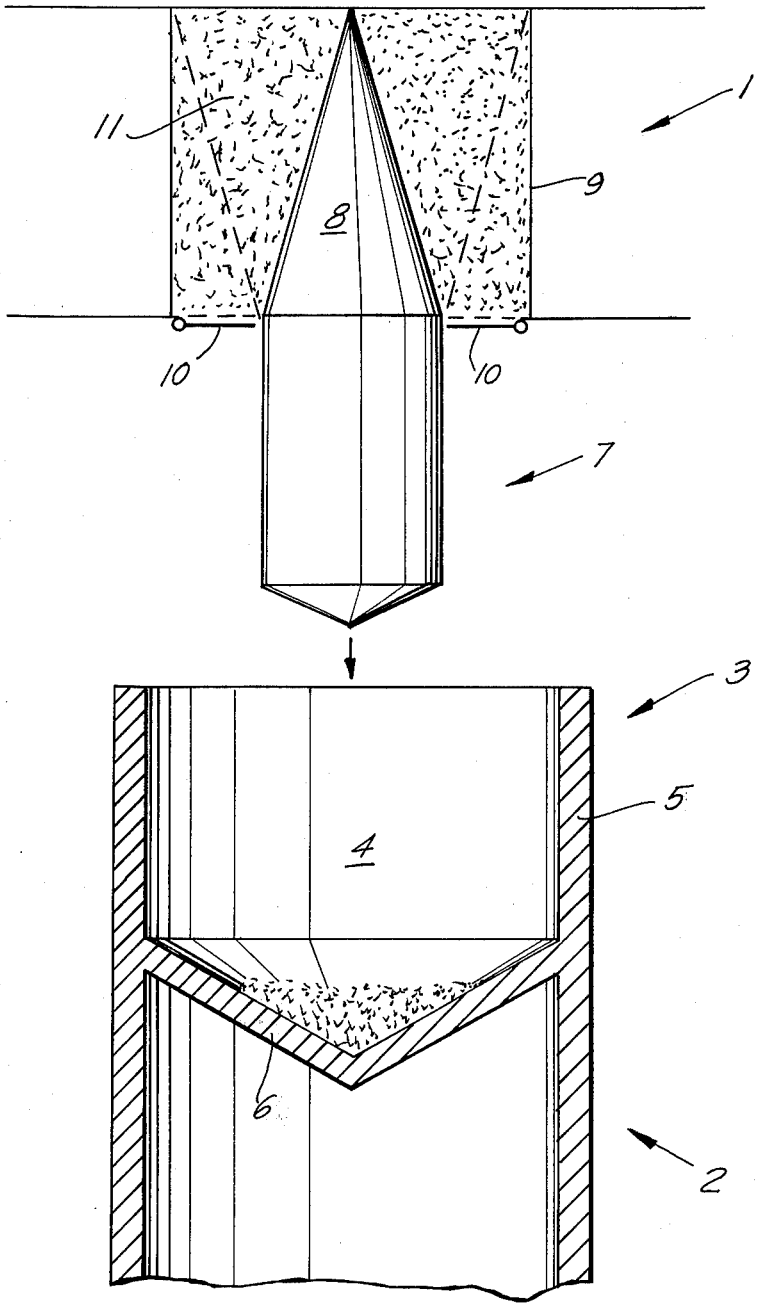
FIG. 1 is a vertical cross-sectional view through an assembly, in accordance with the invention, shown in diagrammatic form and comprising a column previously anchored in the sea floor or on a portion of an off-shore drilling island adapted to support a platform.
Figure 2:
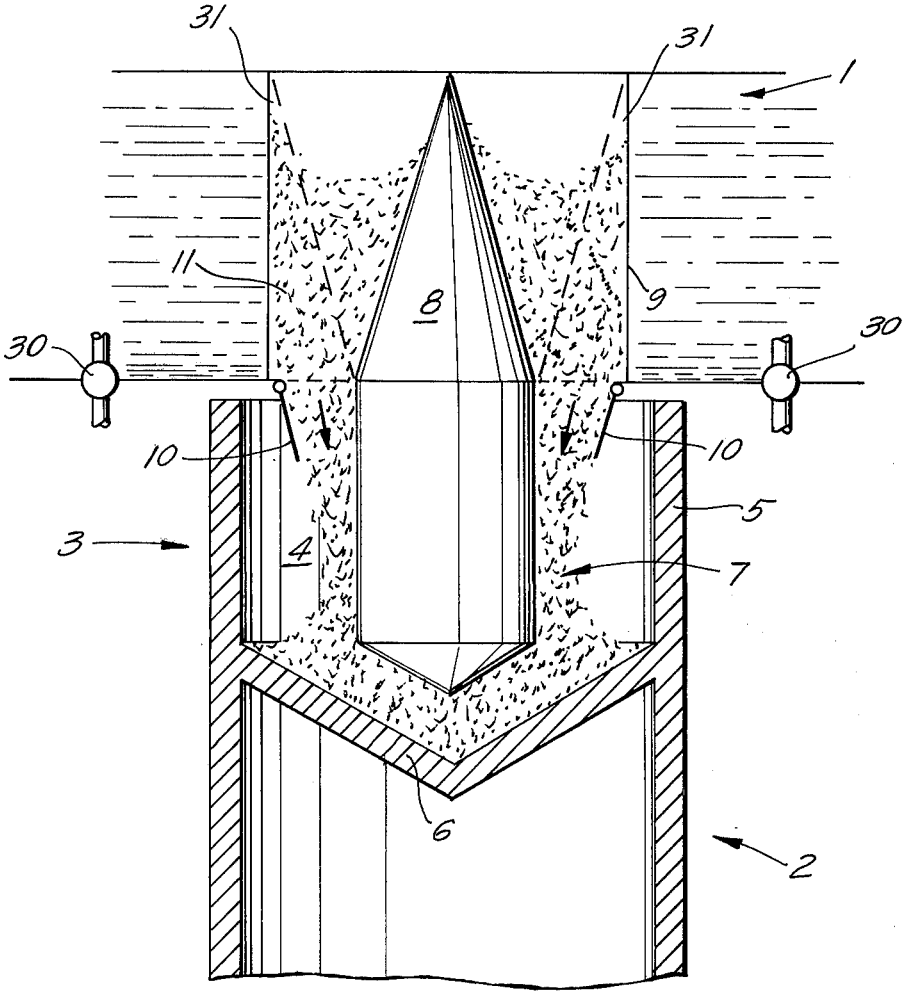
FIG. 2 is a view of the assembly in another position, i.e. after positioning of the platform.

In FIGS. 1 and 2, more specifically, I have shown the drilling and production platform 1 as a semi-submersible vessel which can be floated into position with the plungers 7 above the respective sockets formed at the upper ends of the posts.

The deck load of the platform may range up to 40,000 Mp (Mp = 1,000 Kp where Kp = Kg-f, i.e. kilograms-force). To carry this load it is preferred to provide the posts 2 as part of an off-shore drilling island.

As can be seen from FIGS. 1 and 2, the heads 3 of the cylindrical shafts 2 are formed as upwardly open cylindrical sockets or sand-receiving post 4 having a cylindrical wall 5 and a downwardly converging conical floor 6. A layer of sand may be previously deposited in each of the sockets for initial cushioning purposes (see FIG. 1).

The underside of the platform 1 is provided, at locations aligned with the layout of the sockets 4, with plungers 7 whose diameters are smaller than the internal diameters of the walls 5 so that these plungers can be received with all-around clearance in the sockets. The socket 4 and the plunger 7 of each post thus form a cylinder-piston arrangement of the telescoping type which can be elongated by a rise of the platform and hence an axial partial withdrawal of each plunger 7 out of the respective socket 4.

The heads 8 of the pistons or plungers 7 are surrounded by sand bunkers 9 which are filled with a granular material having a higher specific gravity than that of water, preferably pea gravel.

The closures of the bunkers are flaps 10 or sliders of the type used in silos for the dispensing of flowable solids. The flaps 10 are so positioned that the space between the walls 5 of the sockets 4 and more particularly the space between the cylinder wall 5 and the plunger 7 are rapidly filled with the sand or gravel 11 upon release of the flaps.

In operation, the platform 1 is positioned above the sockets 4 so that the plungers on the undersides of the platform are aligned with these sockets. The windlesses and hawsers previously described hold the platform in place and lateral fenders can be provided to hold the platform in place against tugs or the like to resist the lateral movement and rolling of the platform with the sea oscillations.

The vertical oscillations of the platform, namely, dip and pitch are, however, not restricted.

Figure 4:
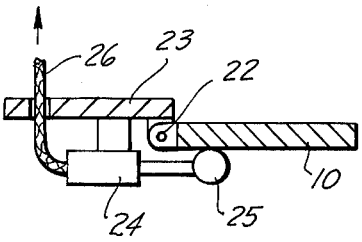
FIG. 4 is a diagrammatic detail view of remote-controlled release means for the closure flap of a sand bunker in accordance with the invention.

The semi-submersible platform is partly flooded, e.g. by the opening of valves 30, to permit water to enter the floodable compartments 31, thereby lowering the plungers 7 slowly into the sockets 4. Before the plungers 7, during the greatest amplitude of the oscillations of the platform, can contact the floor 6 of each socket 4, the load-transfer operation is commenced. To this end, upon attainment of the lower dead point of the plungers 7, the flaps 10 or slides of the respective bunkers are tripped open so that the gravel can pass between the wall 5 of the socket 4 and the outer surface of the plunger 7. During the rise, the gravel fills the space around the plunger 7 so that, when the latter reaches its upper dead point, the plunger can no longer move downward and is locked in place by the sane or gravel. The latter also fills the space directly beneath the plunger. As can be seen in FIG. 4, the flaps 10 can be released by withdrawing a bolt 25 into its guide 24 adjacent the hinge 22 on the floor 23 of the platform via the remotely actuated cable 26.

At its upper end, the plunger 7 is conically convergent upwardly to facilitate the downward flow of the gravel therealong.

The platform thus comes to rest without impact upon the post and is retained in place by the sand against lateral and downward movements.

Should the platform be lifted by a strong force above its first-mentioned upper dead point, this upward movement is unrestricted and the gravel then flows beneath the plunger to retain the platform in its thus raised position.

The process need not be carried out simultaneously at each of the three columns; thus it is possible to fill the sockets of these columns successively with the sand or gravel.

I claim:

1. A system for the securing of a semi-submersible platform to a plurality of upright posts disposed in the sea and anchored therein, said system comprising:

respective upwardly-open sockets formed at the upper ends of each of said posts;

respective plungers projecting downwardly from said platform and receivable with clearance in the respective sockets;

means forming sand bunkers surrounding each of said plungers; and remote-control closures for each of said bunkers openable to discharge a granular material having a specific gravity greater than that of water around the respective plunger and into the respective socket to support the respective plunger therein, said plungers and the respective sockets forming vertically extensible piston-and-cylinder arrangements.

2. The system defined in claim 1 wherein said closures are flaps swingably mounted on said platform.

3. The system defined in claim 2 wherein said plungers have upwardly tapered upper ends extending into said platform and surrounded by granular material in the respective bunker.

4. The system defined in claim 3 wherein each of said sockets has a cylindrical wall spaced outwardly from a cylindrical wall of the respective plunger, and a conical downwardly converging floor.

5. A method of supporting a platform upon a plurality of posts extending in an upright manner in the sea, said method comprising the steps of:

positioning said platform above said posts with downwardly extending plungers fitting into respective upwardly open sockets formed in said posts, each plunger being received in the respective socket with all-around clearance; and upon s rise of said platform relative to said posts, discharging a granular material having a specific gravity greater than that of water around each of said plungers and into the respective socket, thereby forming a bed of said granular material within each socket below the respective post, said granular material in each socket supporting the respective plunger on the respective post against downward movement.

6. The method defined in claim 5 wherein said granular material is sand or gravel.

7. The method defined in claim 6 wherein sand or gravel is introduced simultaneously between each of said plungers and the respective socket.

8. The method defined in claim 6 wherein sand or gravel is disposed in succession between each of said plungers and the respective socket.

9. The method defined in claim 6 further comprising the step of depositing an initial cushion of said granular material in each of said sockets before the lowering of the respective plunger into the respective socket.

10. The method defined in claim 9 wherein sand or gravel is introduced between each plunger and the respective socket only upon the commencement of an upward movement of the respective plunger during vertical oscillations of said platform caused by sea movement.

* * * * *